US005584680A

United States Patent [19]

Kim

[11] Patent Number: 5,584,680

[45] Date of Patent: Dec. 17, 1996

[54] UNVENTED GAS LOG SET

[75] Inventor: Seung-Ho Kim, Fort Wayne, Ind.

[73] Assignee: The Majestic Products Company, Huntington, Ind.

[21] Appl. No.: 282,527

[22] Filed: Jul. 28, 1994

[51] Int. Cl.[6] ..... F24C 3/04

[52] U.S. Cl. ..... 431/125; 431/154; 126/512

[58] Field of Search ..... 431/125, 154; 126/512, 92 AC, 92 R, 41 R, 39 R, 39 B, 40, 39 E

[56] References Cited

U.S. PATENT DOCUMENTS

| | | | |
|---|---|---|---|
| 1,477,971 | 12/1923 | McGowan | 126/40 |
| 1,944,496 | 1/1934 | Copilovich | 126/39 E X |
| 2,011,125 | 8/1935 | Small | 126/40 |
| 2,102,893 | 12/1937 | Forster | 126/40 X |
| 3,042,109 | 7/1962 | Peterson | 431/125 X |
| 3,382,861 | 5/1968 | Peterson | 126/512 X |
| 3,422,810 | 11/1969 | Weiss | 126/41 |
| 3,543,741 | 12/1970 | Whitehead | 431/125 X |
| 3,760,790 | 9/1973 | Vogos et al. | 431/125 X |
| 4,726,351 | 2/1988 | Whittaker et al. | 126/512 |
| 4,779,608 | 10/1988 | Smith | 126/512 |
| 4,793,322 | 12/1988 | Shimek et al. | 126/512 X |
| 4,886,044 | 12/1989 | Best | 126/41 R X |
| 4,962,750 | 10/1990 | Bridgewater | 431/125 X |
| 4,971,031 | 11/1990 | Richardson | 126/512 |
| 5,052,370 | 10/1991 | Karabin | 126/512 |
| 5,054,468 | 10/1991 | Moon et al. | 126/512 |
| 5,114,336 | 5/1992 | Karabin et al. | 431/125 |

OTHER PUBLICATIONS

Majco Oak Series Gas Logs Installation and Operating Instructions (No Date).

*Primary Examiner*—Carl D. Price
*Attorney, Agent, or Firm*—Baker & Daniels

[57] ABSTRACT

An unvented gas log set for an unvented fireplace. The unvented gas log set includes a log supporting frame, simulated logs operatively connected to the frame, a flame-producing burner in spaced relationship with the logs, and a pilot for the burner. The unvented gas log set utilizes a single, common fuel pressure regulator to regulate fuel from a source pressure to a reduced operating pressure for both the pilot and the burner. The unvented gas log set may also utilize a burner holder attachable to the log supporting frame for mechanically holding the burner against the log supporting frame to maintain the spaced relationship of the burner with the logs during operation.

2 Claims, 2 Drawing Sheets

UNVENTED GAS LOG SET

BACKGROUND OF THE INVENTION

The present invention pertains to an unvented gas log set for an unvented fireplace.

On occasions when the appearance of a wood-burning fireplace is desired in a room or structure lacking a flue pipe or it is not desired to withdraw heat and moisture from the room, unvented type fireplaces may be utilized. These unvented types of fireplaces are known to utilize unvented gas log sets which are constrained to exhaust directly into the rooms in which they are installed. In order to comply with strict emission standards promulgated to protect room occupants from potential health risks associated with products of combustion resulting from incomplete or improper combustion, these gas log sets are carefully designed to be clean burning.

Multiple pressure regulators have heretofore been utilized in unvented gas log sets to achieve satisfactory operation. Unlike conventional vented gas log sets in which the fuel pressure provided to the pilot is of little concern and can be regulated by merely, for example, use of a thumb screw, it has been found that the pilot pressure in unvented gas log sets must be carefully regulated. Therefore, in order to regulate the pilot pressure to a pressure which according to conventional design is different than the pressure used for the main burner, a pressure regulator in addition to the regulator used to regulate the pressure to the main burner has typically been added. Although functional, the use of two regulators to separately regulate the fuel pressures of the pilot and the burner may unacceptably increase the cost of the unit.

In addition, because with an unvented gas log set it is important that the flames from the burner not impinge upon the simulated wood logs during operation to prevent potentially dangerous carbon monoxide from being created, both the burner and the logs are conventionally fixedly positioned relative to the set frame. More particularly, normally the burner tube is attached to the frame by spot welding. Besides being relatively expensive, this type of attachment may also make the welded location of the burner susceptible to an undesirable leak or corrosion.

Thus, it is desirable to provide an unvented gas log set which may overcome these shortcomings.

SUMMARY OF THE INVENTION

In one embodiment thereof, the present invention provides an unvented gas log set which includes a log supporting frame, at least one simulated log operatively connected to the frame, a flame-producing burner in spaced relationship with the at least one log, a pilot for the burner, and a single fuel pressure regulator in communication with a fuel source, the pilot and the burner. The common fuel pressure regulator regulates the fuel from a source pressure to a reduced operating pressure for both the pilot and the burner.

In another embodiment thereof, the present invention provides an unvented gas log set including a log supporting frame, at least one simulated log operatively connected to the frame, a flame-producing burner in spaced relationship with the at least one log, a burner holder attachable to the log supporting frame for mechanically holding the burner against the log supporting frame to maintain the spaced relationship of the burner with the at least one log during operation, a pilot for the burner, and at least one pressure regulator in communication with a fuel source to regulate the pressure of fuel provided to the burner and the pilot.

One advantage of the unvented gas log set of the present invention is that only a single regulator is used to regulate the operating pressure of the fuel for the pilot and the operating pressure of the fuel for the burner. Another advantage of the present invention is that the burner tube is maintained in a proper operational arrangement without the use of potentially damaging or expensive welding of the burner tube.

BRIEF DESCRIPTION OF THE DRAWING

The above mentioned and other advantages and objects of this invention, and the manner of attaining them, will become more apparent and the invention itself will be better understood by reference to the following description of an embodiment of the invention taken in conjunction with the accompanying drawings, wherein.

Figure 1:
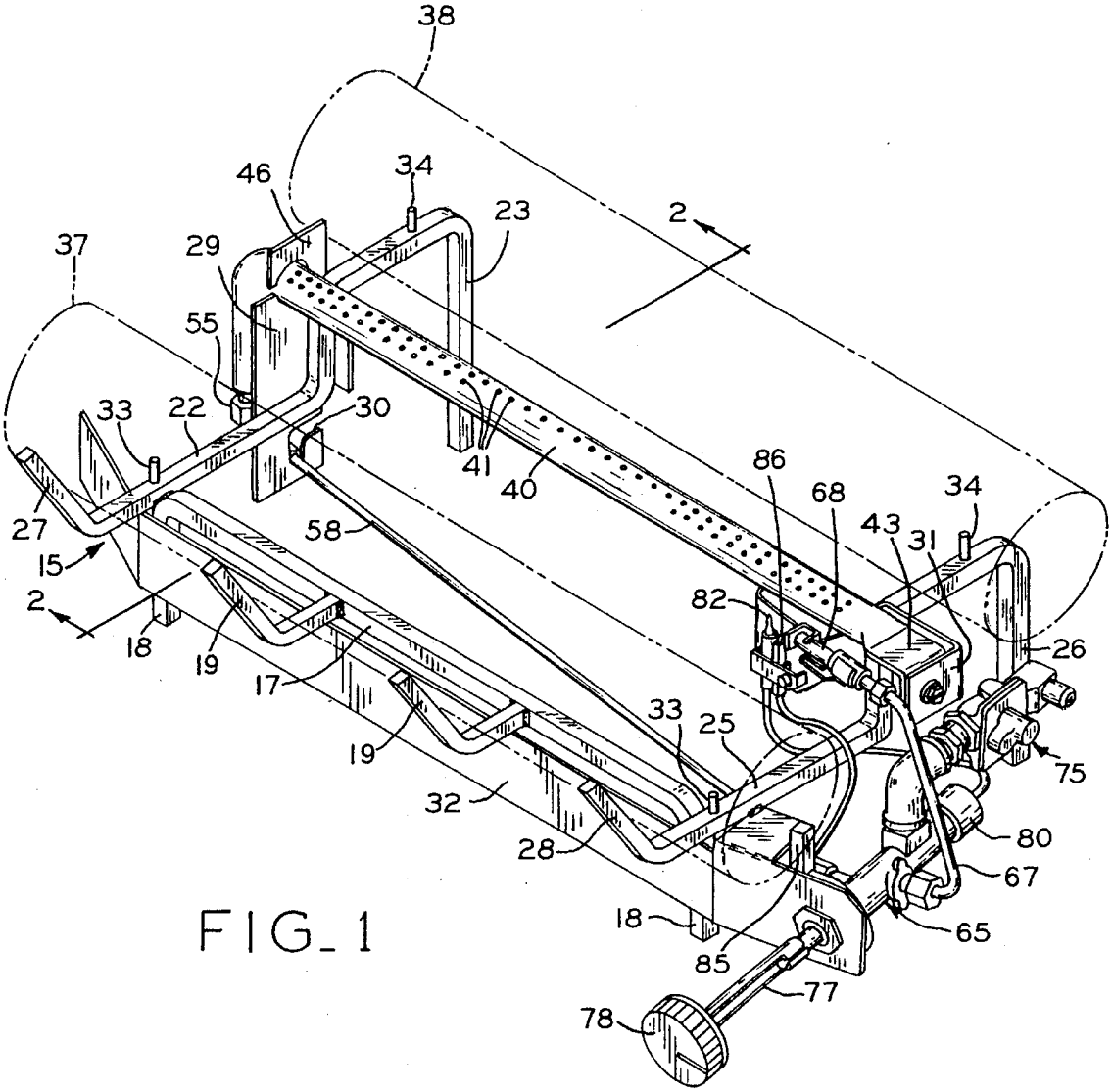
FIG. 1 is a perspective view of the unvented gas log set of the present invention.

Corresponding reference characters indicate corresponding parts throughout the several views. Although the drawings represent an embodiment of the invention, the drawings are not necessarily to scale and certain features may be exaggerated in order to better illustrate and explain the present invention.

DESCRIPTION OF THE PREFERRED EMBODIMENT

The embodiment disclosed below is not intended to be exhaustive or limit the invention to the precise form disclosed in the following detailed description. Rather, the embodiment is chosen and described so that others skilled in the art may understand its teachings.

Referring to FIG. 1, there is shown a perspective view of the unvented gas log set of the present invention, generally designated 10, removed from its fireplace environment. Gas log set 10 includes a log supporting frame, generally designated 15, which rests on a hearth of an unvented fireplace and upon which the ceramic or cement logs are mounted. While a particular frame configuration is shown which preferably also supports the remainder of the device components, frame 15 may be otherwise constructed within the scope of the present invention. Frame 15 includes a forward transverse beam 17 with legs 18 at either end and simulated log retainers 19 along its length. Two-tiered side beams 22, 25 with rear legs 23, 26 and forwardly extending log retainers 27, 28 are fixedly attached by welding to opposite ends of transverse beam 17. Frame 15 is also shown including a vertically oriented burner mounting plate 29, welded to left side beam 22, burner mounting component 31, welded to right side beam 25, and an angled face plate 32, welded to legs 18 and the underside of side beam 25. Upwardly extending pins 33, 34 are provided on the upper surface of forward and rearward horizontal tiers of both side beams 22, 25. Pins 33, 34 cooperate with recesses provided in ceramic or cement, simulated wood logs 37, 38 shown in shadow to positively locate logs 37, 38 relative to frame 15.

A tubular main burner 40 with rows of flame ports 41 is horizontally positioned between logs 37, 38. At its downstream end, main burner 40 is formed with an L-shaped flange 43 which is mechanically fastened such as with a screw to the frame burner mounting component 31. At the upstream end of the rows of flame ports 41, and as best shown in the cross-sectional view of FIG. 2, main burner tube 40 fits into an arcuate notch formed in the upper surface of the frame burner mounting plate 29.

Figure 2:
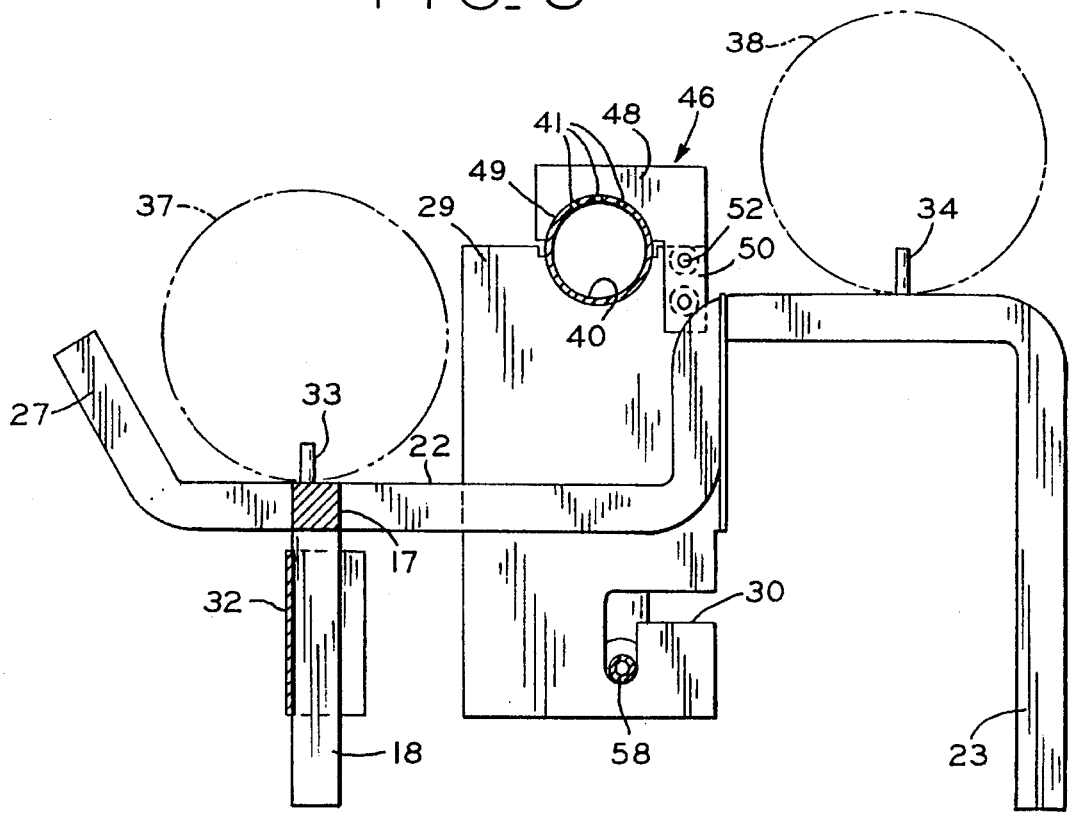
FIG. 2 is a cross-sectional side view, taken along line 2—2 of FIG. 1, showing a preferred embodiment of the burner holder of the present invention.

Holding main burner 40 within the notch of mounting plate 29 is burner holder 46. As frame plate 29 is in fixed spaced relationship with logs 37, 38 as they are respectively rigidly attached to or positively located relative to side beam 22, burner holder 46 maintains main burner tube 40 in a proper operational arrangement such that flames emitted from flame ports 41 do not impinge upon logs 37, 38. As shown in FIG. 2, which shows a preferred holder configuration, burner holder 46 is substantially L-shaped with a holder leg 48 and an attachment leg 50. Burner holder 46 may be stamped from a thin metal plate so as to be inexpensively formed. An arcuate or concave notch 49 formed in holder leg 48 is shaped complementarily to the tubular shape of main burner 40 such that burner holder 46 closely fits over main burner 40. Attachment leg 50 receives preferably mechanical fasteners 52 such as screws to firmly secure burner holder 46, and thereby main burner 40, to frame plate 29. It will be appreciated that differently shaped burner holders 46 may be substituted for the L-shaped notched version shown. Moreover, burner holder 46 can be indirectly or directly attached in a number of manners, and at a variety of locations, to frame 15, as well as possibly clamp or hold burner 40 against different portions of frame 15.

The curved upstream end of main burner 40 connects to an elbow fitting 55 (See. FIG. 1) which attaches to a fuel conveying conduit attached to the fuel valving. A preferred conduit is 5/16 inch diameter aluminum tubing 58, which is supported within channel 30 provided in burner mounting plate 29, and which is attached at its upstream end with a first fuel outlet port provided in gas valve assembly 65.

Figure 3:
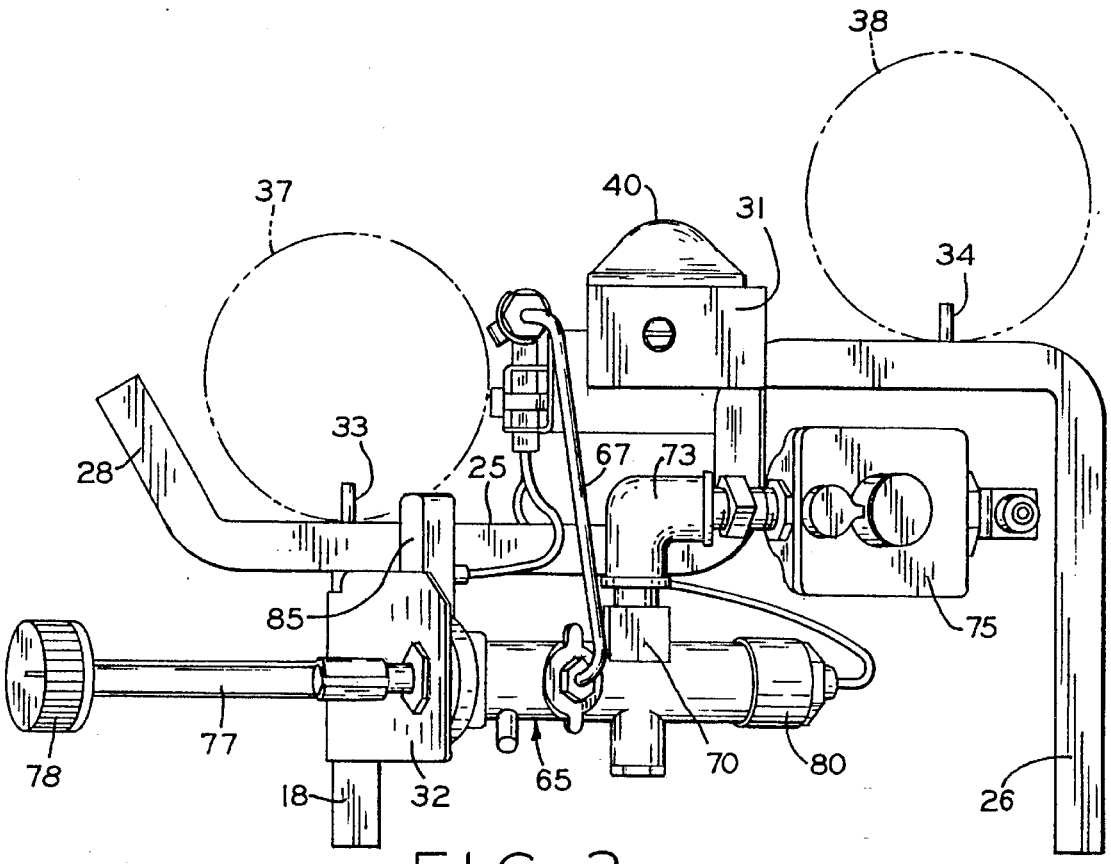
FIG. 3 is a right side elevational view of the unvented gas log set of FIG. 1.

Referring now to FIGS. 1 and 3, the pilot and preferred fuel delivery system will be more particularly explained with reference to the burning of natural gas, although other fuels such as propane may be employed. Gas valve assembly 65 is shown and explained as a commercially known natural gas valve available from Copreci of Aretxabaleta, Spain as Model No. 24100-92. The gas valving of the present invention may be alternatively configured within the scope of the invention. Gas valve assembly 65 includes a second fuel outlet port to which is attached a fuel conveying conduit to the pilot. A preferred conduit is a 3/16 inch diameter aluminum tubing 67 to which is connected pilot 68 of any suitable type known in the art. The shown natural gas pilot is available from Copreci of Aretxabaleta, Spain as Model No. 21500-20. Projection 70 of gas valve assembly 65 includes a fuel inlet port which is in flow communication with pressure regulator 75 via an elbow connection 73. A suitable pressure regulator is available from Maxitrol of Southfield, Mich. The tubing or connections between pressure regulator 75 and a source of fuel 90 at a relatively high pressure is not shown.

A valve stem, which is slidably and rotatably disposed internally within gas valve assembly 65 and is spring biased to a closed position closing fuel flow communication between the fuel inlet port and fuel outlet ports, is operatively attached to control rod 77 of gas control knob 78. An electromagnetic assembly 80, which when energized holds the valve plug in an opened position, is disposed at the rearward end of gas valve assembly 65 and is electrically connected to a thermocouple having a thermocouple junction 82 (see FIG. 1) mounted to be heated by the operational flame of pilot 68. At the forward end of gas valve assembly 65 and operatively attached to control rod control rod 77 is a piezo-ignitor apparatus 85 which generates a spark that is conveyed to and exposed at distal ceramic end 86 mounted adjacent pilot 68.

The structure of unvented gas log set 10 will be further understood in view of the following explanation of its lighting and operation. The natural gas fuel supplied by fuel source 90 is conveyed to pressure regulator 75 at a relatively high pressure measured as about seven inches of water column pressure. Pressure regulator 75 regulates the pressure of the natural gas introduced to the inlet port of valve assembly 65 down to a pressure measured as about three inches of water column pressure. This lower pressure is a suitable operating pressure for pilot 68. At this point, valve assembly 65 is in a closed arrangement such that no natural gas at the inlet port reaches either fuel conveying tubing 67 to pilot 68 or fuel conveying tubing 58 to main burner 40. To light unvented gas log set 10, an operator first forces control rod 77 rearward or toward angled face plate 32 and then, while holding it at a rearward position, rotates control rod 77 to a pilot lighting position. When forced rearward, the valve plug to which control rod 77 is attached slides rearwardly within valve assembly 65, against the bias of the internal spring, to open a passageway through which natural gas passes from the fuel inlet port of valve assembly 65 into the fuel outlet port and tubing 67 and to pilot 68. This movement of the internal valve plug does not open a gas flow passageway to tubing 58. During the rotation of control rod 77, piezo-ignitor apparatus 85 is actuated, and a generated spark at distal ceramic end 86 ignites the gas flowing from pilot 68 to create a flame.

The pilot flame is positioned to heat thermocouple junction 82. Consequently, while the operator continues to hold in control rod 77 and thereby the valve stem at a rearward location such that natural gas continues to flow to pilot 68, thermocouple junction 82 continues to heat up until sufficient electricity is generated within the thermocouple to activate electromagnetic assembly 80. When activated, electromagnetic assembly 80 magnetically engages the internal valve plug to hold the plug in the rearward or opened position. An operator can then stop forcing control rod 77 rearwardly.

Main burner 40 can then be lighted. By further rotating control rod 77 and thereby the internal valve plug, various sized orifices within the valve plug can be separately aligned with the fuel outlet port in communication with tubing 58. Passageways through which natural gas passes from the fuel inlet port of valve assembly 65 into tubing 58 and main burner 40 result from these alignments, and the gas passing through burner 40 is lighted by pilot 68. The various sizes of the valve orifices impact the flow of gas and therefore the flame size of main burner 40.

Figure 4:
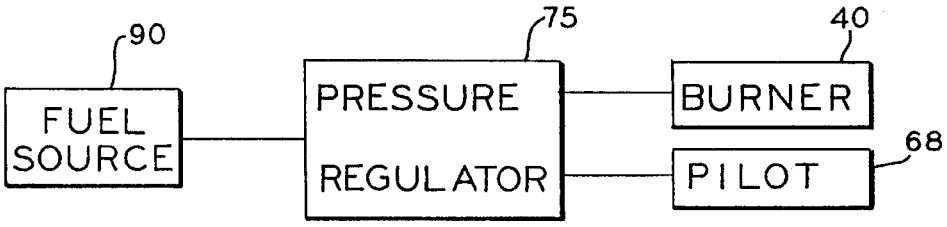
FIG. 4 is a schematic of the fuel flow path of the unvented gas log set of the present invention.

It will be appreciated that in the above described manner fuel at a single regulated pressure is utilized for both pilot 68 and main burner 40. As represented in FIG. 4, the high pressure fuel from fuel source 90 is advantageously regulated by a single, common pressure regulator 75 to an operational pressure, and regulator 75 effectively outputs this fuel at operational pressure in parallel to pilot 68 and main burner 40.

While this invention has been described as having a preferred design, the present invention may be further modified within the spirit and scope of this disclosure. This application is therefore intended to cover these and any other variations, uses, or adaptations of the invention using its general principles. Further, this application is intended to cover such departures from the present disclosure as come within known or customary practice in the art to which this invention pertains.

What is claimed is:

1. An unvented gas log set for use with a fuel source comprising:

a log supporting frame comprising a vertically oriented burner mounting plate, said mounting plate comprising an arcuate surface;

at least one simulated log supported on said frame;

a flame-producing, cylindrical tubular shaped burner in spaced relationship with said at least one log, said burner comprising a first peripheral surface region and a second peripheral surface region spaced apart along the circumference of said cylindrical tubular burner, wherein said first peripheral surface comprises an underside of said cylindrical tubular burner; and a burner holder including a holder leg and an attachment leg, said attachment leg mechanically attachable to said log supporting frame, and wherein said cylindrical tubular burner is captured between said holder leg and said log supporting frame with said burner first peripheral surface region facing said log supporting frame and said burner second peripheral surface region facing said holder leg when said attachment leg is attached to said frame, said holder leg comprising a concave notch shaped complementarily to said cylindrical tubular shape of said burner, said burner mounting plate arcuate surface shaped complementarily to said burner cylindrical tubular shape, and wherein said first peripheral surface region faces said mounting plate.

2. An unvented gas log set for use with a fuel source providing fuel at a source pressure comprising:

a log supporting frame including a vertically oriented burner mounting plate;

at least one simulated log operatively connected to said frame;

an elongate, tubular shaped flame-producing burner in spaced relationship with said at least one log;

a burner holder including a holder leg connected to an attachment leg, said attachment leg being attachable to said burner mounting plate with at least one mechanical fastener, said holder leg being structured to overhang and hold said tubular shaped burner against said burner mounting plate to maintain said spaced relationship of said burner with said at least one log during operation;

a pilot for said burner; and a single fuel pressure regulator, in communication with the fuel source, said pilot and said burner, for regulating the fuel from the source pressure to a reduced operating pressure for both said pilot and said burner.

* * * * *